United States Patent [19]

Maurice

[11] Patent Number: 4,641,505

[45] Date of Patent: Feb. 10, 1987

[54] SECURITY DEVICE FOR REAL ESTATE BROKERS

[76] Inventor: Thomas A. Maurice, 9111 Orangevale Ave., Orangevale, Calif. 95662

[21] Appl. No.: 707,383

[22] Filed: Mar. 1, 1985

Related U.S. Application Data

[63] Continuation-in-part of Ser. No. 433,981, Dec. 27, 1982, Pat. No. 4,532,783.

[51] Int. Cl.[4] ..... E05B 65/48

[52] U.S. Cl. ..... 70/63; 70/162

[58] Field of Search ..... 70/14, 52, 53, 63, 158–169; 109/23, 52

[56] References Cited

U.S. PATENT DOCUMENTS

| | | | |
|---|---|---|---|
| 3,436,937 | 4/1969 | Barrett | 70/63 |
| 3,979,932 | 9/1976 | Piche | 70/63 |
| 4,325,240 | 4/1982 | Gable | 70/63 |
| 4,488,764 | 12/1984 | Pfenning | 70/63 |
| 4,532,783 | 8/1985 | Maurice | 70/63 |

*Primary Examiner*—Robert L. Wolfe

*Attorney, Agent, or Firm*—Leonard Bloom

[57] ABSTRACT

A real estate security device for controlling access to premises by realtors. A housing having a shackle lock is removably locked to a door handle of the premises. A barrier precludes access to the shackle from an interior of the housing. A portal communicates the housing interior with an area outside through a sliding door. A door lock independent from the shackle lock opens the door to the housing to allow access to contents of the interior where a premises key can be located when the premises' owner wishes to allow access to the premises.

22 Claims, 9 Drawing Figures

SECURITY DEVICE FOR REAL ESTATE BROKERS

CROSS REFERENCE TO RELATED INVENTIONS

This application constitutes further developments in and is a continuation in part of The Double Lock Lock Box, Ser. No. 433,901 filed Dec. 27, 1982 and now U.S. Pat. No. 4,532,783, incorporated herewith in its entirety by reference.

FIELD OF THE INVENTION

This invention relates generally to security devices for selectively allowing access to the premises of a property owner to be shown to prospective purchasers or renters.

BACKGROUND OF THE INVENTION

Lock boxes are known to exist in the real estate industry, the purpose for which is to allow access to the premises of a property to be shown to prospective buyers. A shackle-type lock is supported by a housing, the housing having an interior which is accessible by means of a key or other locking instrumentality. In some instances, the owner of the premises loses control when the broker can gain access to the house and breaches of security or privacy can occur. In other instances, particularly when multiple listings are relied upon, a large number of people have access to the premises posing a further security risk.

SUMMARY OF THE INVENTION

Accordingly, it is an object of the present invention to provide a real estate security device for controlling access to premises which enhances the privacy and security of the occupant while still affording controlled access to the premises by a broker.

It is another object of this invention to provide a device as characterized above in which a first lock is provided allowing access to the interior of the lock box, the interior normally carrying a key therein permitting entry into the premises. This first lock and key assembly are readily dissociated from the rest of the lock housing so that an entire set of lock boxes may be converted to a new key system en masse for security.

A further object of this invention contemplates providing a device as characterized above wherein a second key and its associated tumbler system can be rekeyed in a facile manner. This key operates the shackle which the owner places for controlled premises access.

A further object of this invention contemplates providing a device as characterized above which is relatively inexpensive to make, lends itself to mass production techniques, and is extremely reliable and durable in service.

A further object of this invention contemplates providing a real estate security device for controlling access to premises by realtors or the like comprising, in combination, a housing having a shackle lock adapted to be removably locked to a door handle of the premises, a barrier precluding access to the shackle from an interior of the housing, a portal communicating the housing interior with an area outside the housing, a sliding door for occluding the portal, and a door locking means independent from said shackle locking means to removably lock the door to the housing to allow access to contents of the interior where a premises key can be located. The premises' owner wishes to allow access to the premises by hanging the double lock system on the door handle.

A further object of this invention contemplates providing a device as characterized immediately above wherein the sliding door includes a trackway disposed on the housing. This door is capable of longitudinal translation within the trackway, whereby the door can slide from a first to a second position, occluding or exposing the housing interior and therefor the premises' key.

A further object of this invention contemplates providing a device as characterized above wherein the shackle lock is embodied as a cap adapted to be disposed within a top portion of the housing containing structure for removably securing the shackle lock to the housing. This allows placement on the premises door handle.

A further object of this invention contemplates providing a device as characterized immediately above wherein the sliding door lock is carried on the sliding door itself removably attached thereto by means of a grub screw which is carried on a face of the sliding door which is normally occluded by the housing when in a closed position protecting the interior of the housing. Thus a plurality of sliding doors can be substituted to expeditiously replace locking mechanisms with sets of locks.

A further object of this invention comtemplates providing an alternative device to that characterized immediately above wherein the portal lock includes a locking instrumentality carried on a bottom face of the housing having a portion extending within a second interior of the housing. This second interior is separate from the first interior by means of a barrier. This lock includes a cam adapted to rotate between first and second positions, a first position adapted to engage a groove carried on a face of the sliding door adjacent the housing to constrain it in a fixed relationship and a second position allowing the sliding door to be moved along the trackway.

These and other objects will be made manifest when considering the following detailed specification when taken in conjunction with the appended drawing figures.

DESCRIPTION OF THE DRAWING FIGURES

FIGS. 1A and 1B reflect side views of two variations according to the present invention taken with portions partially fragmented for clarity.

FIG. 2A and 2B respectively indicate sectional views taken along line II—II of FIGS. 1A and 1B.

DESCRIPTION OF THE PREFERRED EMBODIMENT

Figure 1A:
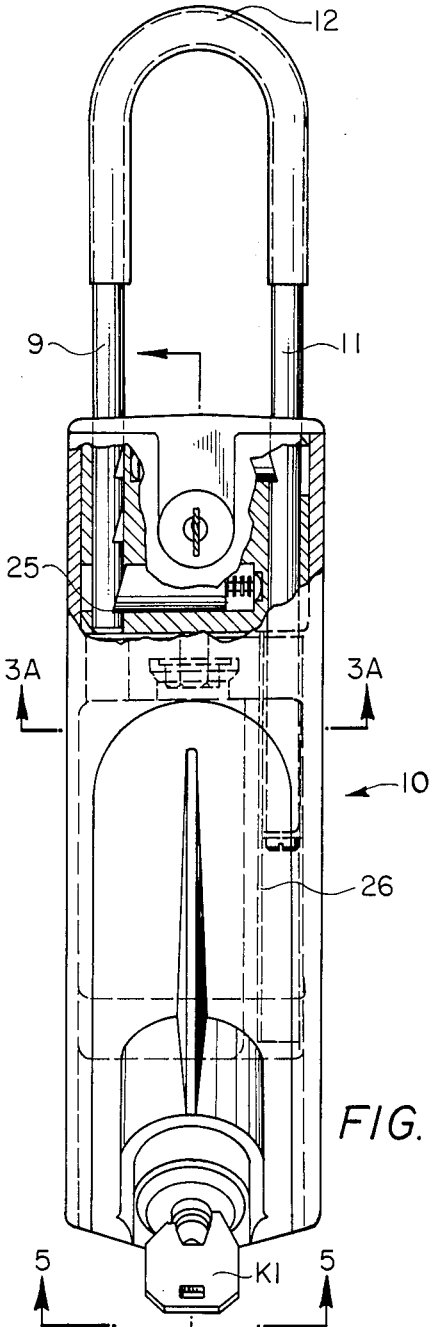
Figure 3A:
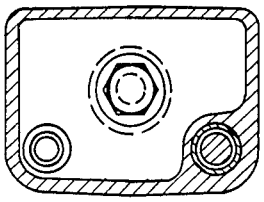
FIGS. 3A and 3B are sections taken along line III—III of FIGS. 1A and 1B, respectively.
Figure 2A:
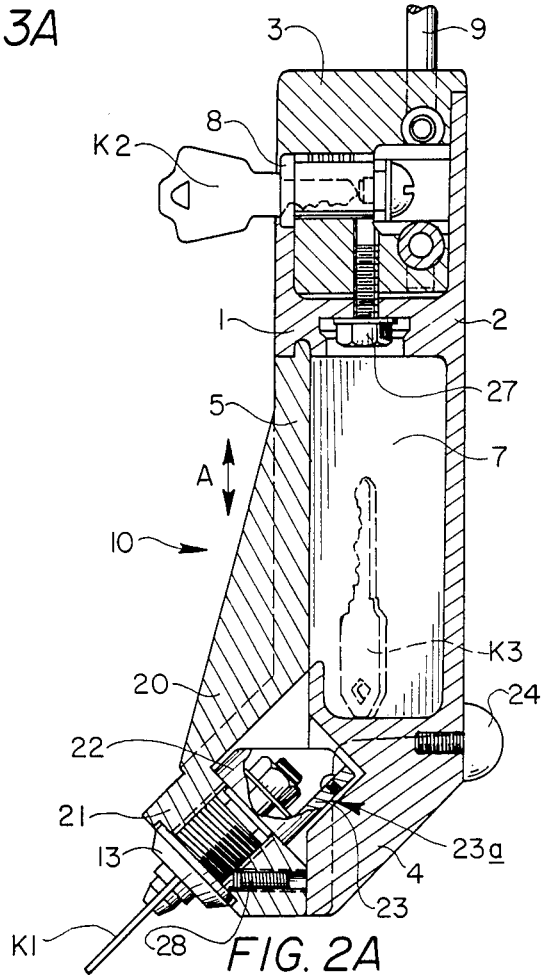
Figure 5:
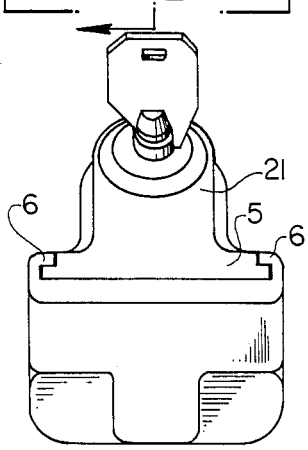
FIG. 5 is a bottom view of that which is shown in FIG. 1A.
Figure 4A:
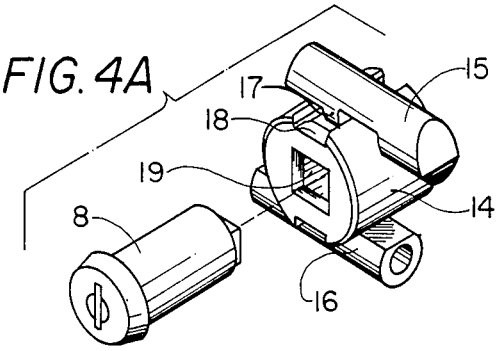
FIGS. 4A and 4B are perspective views of each respective upper lock mechanism.
Figure 1B:
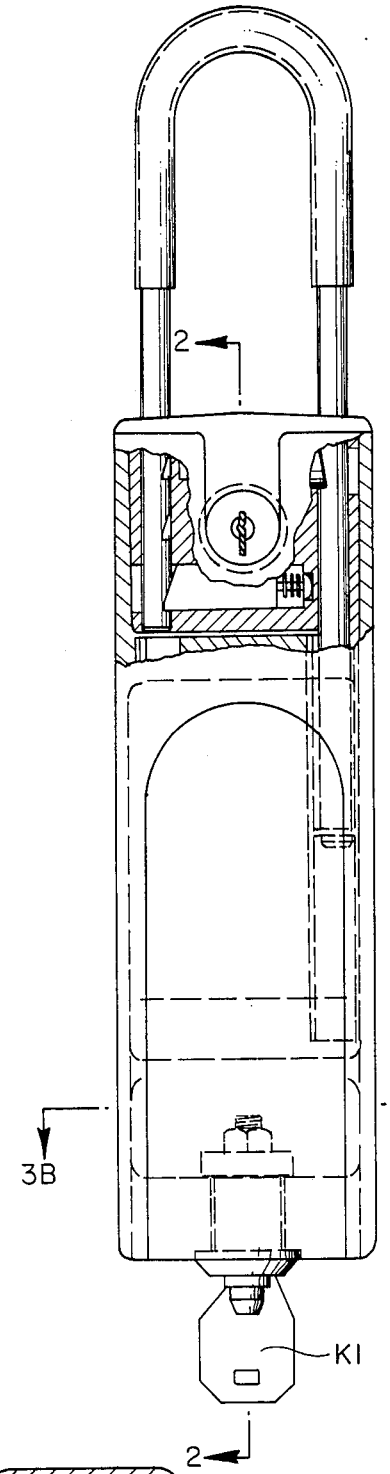
Figure 2B:
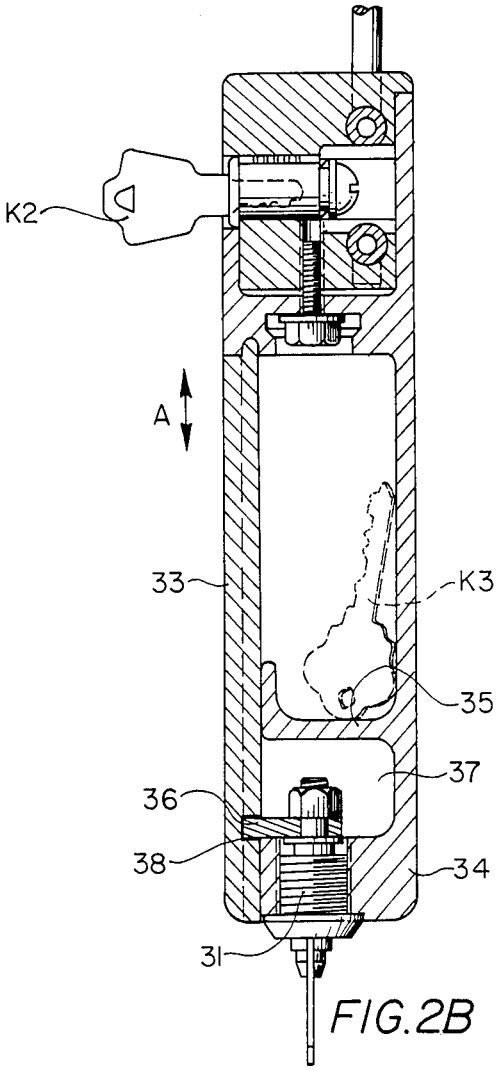
Figure 3B:
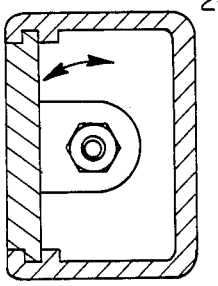
Figure 4B:
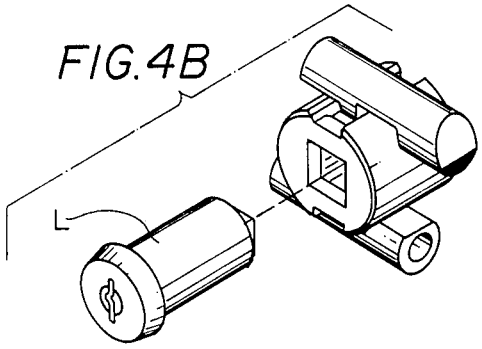

Referring to the drawings now, particularly FIGS. 1A–4A and FIG. 5, like reference numerals refer to like parts throughout. With respect to FIGS. 1B–4B, common reference numerals from FIGS. 1A–4A will also apply.

More particularly, both species of the invention include a housing 10 formed from substantially rectangular stock material having a front wall 1, a rear wall 2, and side walls with a hollow interior 7 adapted to serve as a receptacle for example to include a premises key, K-3. The front wall is provided with a portal which allows slideable reception therein of a door 5. More particularly, and when viewed from FIG. 5, the door 5 communicates with a trackway having upwardly and inwardly extending flange members 6 running the entire length of the door so that the door can move in the direction of the arrows A upon apropriate manipulation of a key and lock member, the key bearing the legend K-1.

More particularly, the door 5 includes a centrally vertically disposed rib member 20 which extends at its lowermost portion to support a key lock housing 21 within which a lock mechanism 13 is provided adapted to rotate upon insertion of the proper key, K-1, therewithin. The net effect of rotating the key and therefore the associated lock is to rotate a cammed surface 22 which is formed as an obliquely truncated cylinder in and out of engagement with an associated lip 23 carried on a lower portion 4 of the housing 10. Thus, freeing the cammed surface 22 from under the lip 23 allows the door 5 to move in the direction of the arrow A. Alternatively, the cam surface 22 can abut directly on the sloped surface 23a upon which the lip 23 is supported. In this event, the lip 23 is not necessary. If clearance problems exist, the cam can be shimmed. If desired, the door 5 may be completely removable from the trackway 6 or alternatively, a stop member may be provided so that the door hangs part of the way down but still capable of exposing the interior 7. In the eventuality that the door is totally removable, an entire new lock can be expeditiously inserted along with a door in favor of the existing lock arrangement should security so dictate. Alternatively, the key cylinder 13 can be selectively removable by means of a grub screw 28 which is only exposed when the door is dislodged from occluding the portal.

As shown in the drawings, the bottom portion of the housing 4 has an angulated contour which communicates with a vertical back wall 2, the intersection therebetween including a rubber bumper 24 to protect the finish of any article, such as the premises door, against which the lock is placed.

The top portion of the housing includes a cap 3 adapted to be received within an associated recess defined by the uppermost extremities of front wall 1, back wall 2 and side walls. The plug member 3 may be frictionally fit therewithin. Alternatively, a bolt 27 can extend through a solid body portion extending between front, side and rear walls to fix the cap 3 in position. In this event, the top cap portion 3 can be removably affixed once access has been gained to the interior 7. Further, once the cap member has been installed, a plug can be placed over the bolt 27 for security. If the bolt 27 remains exposed, the cap 3 is readily removeable from the major portion of the body housing 10 so that a new locking instrumentality for the top can be quickly provided as opposed to replacing a cylinder 8.

More particularly, a key, K-2, is adapted to actuate a lock cylinder 8 so as to releaseably engage a shackle having a first vertical leg 9, a second vertical leg 11 and a medially disposed bight portion 12, the bight portion including a rubber shroud which protects the premises' door handle from marring.

The lock 8 can free the shackle by causing rotation of an associated lock sleeve 14. The cylinder 8 drives a squared opening 19 of the sleeve 14. The net effect of rotating the sleeve 14 is to cause first and second transverse members 15, 16 to move along their longitudinal axes in response to their interengagement by their associated projections carried within slots 18 on the sleeve 14. As shown in FIG. 1A, for example, axial translation of members 15 and 16 in opposite directions allows the shackle legs 9 and 11 to translate vertically by removal of the tip 25 of each of the transverse members from engagement with an associated notch on the shackle legs. The transverse members 15 and 16 are spring biased to cause them to engage the shackle notches in the absence of pressure from the slots 18.

FIGS. 1B–4B are indicative of a further embodiment, and like reference numerals refer to like parts throughout the various drawing figures. The most notable difference when comparing FIG. 2A with 2B, for example, is the configuration of the lower lock K-1. In the FIG. 2B embodiment, the key K-1 is disposed in a bottom portion 34 of its housing, and its key cylinder lock 31 extends within a second hollow 37 of the housing, the second hollow being separated from the first hollow 7 by means of a partition 35. The lock 31 is vertically disposed and includes a cam member 36 embodied as a radially extending arm adapted to be engaged within an associated groove 38 carried on door 33 so that removal of the cam 36 from the slot 38 allows translation of the door in the direction of the arrow A.

In some instances, the housing of each of the locks 8, 13, and 31 associated with keys K-1 and K-2 can be provided with flanged lips portions circumscribing the lock itself so that conventional tools cannot be used to remove the lock and thereby thwart the purposes for which this invention is intended.

Moreover, having thus described the invention, it should be apparent that numerous structural modifications are contemplated as being a part of this invention as set forth hereinabove and as defined hereinbelow by the claims.

What is claimed is:

1. A lock comprising, in combination, a housing having an interior and a portal communicating said interior with areas external said housing, said portal having two sides provided with opposed facing trackways, a sliding door cover dimensioned to occlude said portal by sliding within said trackways, a solidary locking means fixedly securing said sliding door on said housing, actuation of said solitary locking means moving said cover from locking engagement with said housing to exposing said housing interior, a shackle supported by said housing having a first segment extending beyond said housing and a second segment within said housing yet not accessible from said housing interior, whereby access to said interior does not provide communication with said shackle second segment, and shackle locking means passing through said housing isolated from said interior and operatively connected to lock and unlock said shackle, said shackle locking means inaccessible from said interior to thereby provide two distinct locking systems.

2. An article or key safe comprising, in combination:

a housing, said housing having an open top, imperforate side walls, a rear wall, a bottom wall and a front wall with a portal opening therein, a cap closing said open top, said walls and said cap defining an interior chamber, a shackle having a pair of spaced-apart legs slidably disposed through yet retained by said cap, first locking means operatively associated with latch means carried within said cap to engage said shackle, whereby said shackle can move from a first locked position which secures said key safe to a premises door handle or the like, to a second open position allowing removal of said key safe, a slidably removable door closing said opening in said front wall whereby displacing said door allows access to said interior chamber and its contents, a singular second locking means operatively associated with said sliding door which in a first operative position solely secures said door in a locked relationship with said front wall completely covering said portal opening, and in a second inoperative position solely allows the translation of said door from said portal opening revealing said interior chamber.

3. A real estate security device for controlling access to premises by realtors or the like comprising, in combination:

a housing having a shackle locking means adapted to be removably locked to a door handle of the premises, a barrier precluding access to said shackle from an interior of said housing, a portal communicating said housing interior with an area outside said housing, sliding door means for occluding said portal, and door locking means independent from said shackle locking means to removably lock said door to said housing to allow access to contents of said interior where a premises key can be located when the premises' owner wishes to allow access to the premises.

4. The device of claim 1 wherein said sliding door means includes a trackway disposed on said housing, said cover capable of longitudinal translation within said trackway, whereby said door can move from a first to a second position.

5. The device of claim 2 wherein said sliding door means includes a trackway disposed on said housing, said cover capable of longitudinal translation within said trackway, whereby said door can move from a first to a second position.

6. The device of claim 3 wherein said sliding door means includes a trackway disposed on said housing, said cover capable of longitudinal translation within said trackway, whereby said door can move from a first to a second position.

7. The device of claim 4 wherein said shackle locking means is embodied as a cap adapted to be disposed within a top portion of said housing, and means for removably securing said shackle locking means from said housing.

8. The device of claim 5 wherein said shackle locking means is embodied as a cap adapted to be disposed within a top portion of said housing, and means for removably securing said shackle locking means from said housing.

9. The device of claim 6 wherein said shackle locking means is embodied as a cap adapted to be disposed within a top portion of said housing, and means for removably securing said shackle locking means from said housing.

10. A lock comprising, in combination, a housing having an interior and a portal communicating said interior with areas external said housing, said portal having two sides provided with opposed facing trackways, a sliding door cover dimensioned to occlude said portal by sliding within said trackways, wherein said sliding door means includes a trackway disposed on said housing, said cover capable of longitudinal translation within said trackway, whereby said door can move from a first to a second position, a solitary locking means fixedly secured said sliding door on said housing, actuation of said solitary locking means moving said cover from locking engagement with said housing to exposing said housing interior wherein said sliding door locking means includes a lock carried on said cover removably attached thereto by means of a grub screw carried on a face of said cover which is normally occluded by said housing when said door is in a closed position protecting the interior of said housing, whereby a plurality of doors can be substituted to expeditiously replace locking mechanisms for sets of locks, a shackle supported by said housing having a first segment extending beyond said housing and a second segment within said housing yet not accessible from said housing interior, whereby access to said interior does not provide communication with said shackle second segment, and shackle locking means passing through said housing isolated from said interior and operatively connected to lock and unlock said shackle, wherein said shackle locking means is embodied as a cap adapted to be disposed within a top portion of said housing; and means for removably securing said shackle locking means from said housing, said shackle locking means inaccessible from said interior to thereby provide two distinct locking systems.

11. An article or key safe comprising, in combination:

a housing, said housing having an open top, imperforate side walls, a rear wall, a bottom wall and a front wall with a portal opening therein, a cap closing said open top, said walls and said cap defining an interior chamber, a shackle having a pair of spaced-apart legs slidably disposed through yet retained by said cap, first locking means operatively associated with latch means carried within said cap to engage said shackle, whereby said shackle can move from a first locked position which secures said key safe to a premises door handle or the like, to a second open position allowing removal of said key safe, wherein said shackle locking means is embodied as a cap adapted to be disposed within a top portion of said housing, and means for removably securing said shackle locking means from said housing, a slidably removable door closing said opening in said front wall whereby displacing said door allows access to said interior chamber and its contents, wherein said sliding door means includes a trackway disposed on said housing, said cover capable of longitudinal translation within said trackway, whereby said door can move from a first to a second position, a singular second locking means operatively associated with said sliding door which in a first operative position solely secures said door in a locked relationship with said front wall completely covering said portal opening, and in a second inoperative position solely allows the translation of said door from said portal opening revealing said interior chamber, wherein said portal locking means includes a lock carried on said cover removably attached thereto by means of a grub screw carried on a face of said cover which is normally occluded by said housing when said door is in a closed position protecting the interior of said housing, whereby a plurality of doors can be substituted to expeditiously replace locking mechanisms for sets of locks.

12. A real estate security device for controlling access to premises by relators or the like comprising, in combination:

a housing having a shackle locking means adapted to be removably locked to a door handle of the premises, wherein said shackle locking means is embodied as a cap adapted to be disposed within a top portion of said housing, and means for removably securing said shackle locking means from said housing, a barrier precluding access to said shackle from an interior of said housing, a portal communciating said housing interior with an area outside said housing, sliding door means for occluding said portal, wherein said sliding door means includes a trackway disposed on said housing, said cover capable of longitudinal translation within said trackway, whereby said door can move from a first to a second position, and door locking means independent from said shackle locking means to removably lock said door to said housing to allow access to contents of said interior where a premises key can be located when the premises' owner wishes to allow access to the premises, wherein said door locking means includes a lock carried on said cover removably attached thereto by means of a grub screw carried on a face of said cover which is normally occluded by said housing when said door is in a closed position protecting the interior of said housing, whereby a plurality of doors can be substituted to expeditiously replace locking mechanisms for sets of locks.

13. A lock comprising, in combination, a housing having an interior and a portal communicating said interior with areas external said housing, said portal having two sides provided with opposed facing trackways, a sliding door cover dimensioned to occlude said portal by sliding within said trackways, wherein said sliding door means includes a trackway disposed on said housing, said cover capable of longitudinal translation within said trackway, whereby said door can move from a first to a second position, solitary locking means fixedly securing said sliding door on said housing, actuation of said solitary locking means moving said cover from locking engagement with said housing to exposing said housing interior, wherein said sliding door locking means includes a locking instrumentality carried on a bottom face of said housing, having a portion extending within a second interior of said housing, said second interior remote from said first interior by means of a barrier, said second interior and said locking means including a cam embodied as a radial arm adapted to rotate between first and second positions, a first position adapted to engage a groove carried on a face of said cover adjacent said housing to constrain said cover in a fixed relationship with said housing occluding the interior, and a second position allowing said door to be moved along said trackway, a shackle supported by said housing having a first segment extending beyond said housing and a second segment within said housing yet not accessible from said housing interior, whereby access to said interior does not provide communciation with said shackle second segment, and shackle locking means passing through said housing isolated from said interior and operatively connected to lock and unlock said shackle, wherein said shackle locking means is embodied as a cap adapted to be disposed within a top portion of said housing, and means for removably securing said shackle locking means from said housing, said shackle locking means inaccessible from said interior to thereby provide two distinct locking systems.

14. An article or key safe comprising, in combination:

a housing, said housing having an open top, imperforate side walls, a rear wall, a bottom wall and a front wall with a portal opening therein, a cap closing said open top, said walls and said cap defining an interior chamber, a shackle having a pair of spaced-apart legs slidably disposed through yet retained by said cap, first locking means operatively associated with latch means carried within said cap to engage said shackle, whereby said shackle can move from a first locked position which secures said key safe to a premises door handle or the like, to a second open position allowing removal of said key safe, wherein said shackle locking means is embodied as a cap adapted to be disposed within a top portion of said housing, and means for removably securing said shackle locking means from said housing, a slidably removable door closing said opening in said front wall whereby displacing said door allows access to said interior chamber and its contents, wherein said sliding door means includes a trackway disposed on said housing, said cover capable of longitudinal translation within said trackway, whereby said door can move from a first to a second position, a singular second locking means operatively associated with said sliding door which in a first operative position solely secures daid door in a locked relationship with said front wall completely covering said portal opening, and in a second inoperative position solely allows the translation of said door from said portal opening revealing said interior chamber, wherein said portal locking means includes a locking instrumentality carried on a bottom face of said housing, having a portion extending within a second interior of said housing, said second interior remote from said first interior by means of a barrier, said second interior and said locking means including a cam embodied as a radial arm adapted to rotate between first and second positions, a first position adapted to engage a groove carried on a face of said cover adjacent said housing to constrain said cover in a fixed relationship with said housing occluding the interior, and a second position allowing said door to be moved along said trackway.

15. A real estate security device for controlling access to premises by realtors or the like comprising, in combination:

a housing having a shackle locking means adapted to be removably locked to a door handle of the premises, wherein said shackle locking means is embodied as a cap adapted to be disposed within a top portion of said housing, and means for removably securing said shackle locking means from said housing, a barrier precluding access to said shackle from an interior of said housing, a portal communicating said housing interior with an area outside said housing, sliding door means for occluding said portal, wherein said sliding door means includes a trackway disposed on said housing, said cover capable of longitudinal translation within said trackway, whereby said door can move from a first to a second position, and door locking means independent from said shackle locking means to removably lock said door to said housing to allow access to contents of said interior where a premises key can be located when the premises' owner wishes to allow access to the premises, wherein said door locking means includes a locking instrumentality carried on a bottom face of said housing, having a portion extending within a second interior of said housing, said second interior remote from said first interior by means of a barrier, said second interior and said locking means including a cam embodied as a radial arm adapted to rotate between first and second positions, a first position adapted to engage a groove carried on a face of said cover adjacent said housing to constrain said cover in a fixed relationship with said housing occluding the interior, and a second position allowing said door to be moved along said trackway.

16. The device of claim 10 wherein said shackle locking means includes a cylinder adapted to rotate a cylinder sleeve by means of removable connection with a driving surface therebetween, said cylinder sleeve including first and second slots adapted to receive therewithin first and second projections extending therewithin, said projections communicating in turn with transverse members spring biased to hold one position, said shackle having a plurality of notches thereon adapted to receive said transverse member and fix said shackle in a fixed position.

17. The device of claim 11 wherein said shackle locking means includes a cylinder adapted to rotate a cylinder sleeve by means of removable connection with a driving surface therebetween, said cylinder sleeve including first and second slots adapted to receive therewithin first and second projections extending therewithin, said projections communicating in turn with transverse members spring biased to hold one position, said shackle having a plurality of notches thereon adapted to receive said transverse member and fix said shackle in a fixed position.

18. The device of claim 12 wherein said shackle locking means includes a cylinder adapted to rotate a cylinder sleeve by means of removable connection with a driving surface therebetween, said cylinder sleeve including first and second slots adapted to receive therewithin first and second projections extending therewithin, said projections communicating in turn with transverse members spring biased to hold one position, said shackle having a plurality of notches thereon adapted to receive said transverse member and fix said shackle in a fixed position.

19. An article or key safe comprising, in combination:

a housing having a front wall with a portal opening to an interior chamber of said housing where the key is retained, said portal opening having two sides provided with opposed trackways, a sliding door dimensioned to occlude said portal by sliding within said trackways, sliding door locking means for locking said sliding door to the housing to occlude said portal, a shackle supported by said housing having a first segment extending beyond said housing and a second segment within said housing, said shackle for supporting the housing on a door, shackle locking means for locking said shackle to a door.

20. An article or key safe comprising, in combination:

a housing having a front wall with a portal opening to an interior chamber of said housing where the key is retained, said portal opening having two sides provided with opposed trackways, a sliding door dimensioned to occlude said portal by sliding within said trackways, sliding door locking means for locking said sliding door to the housing to occlude said portal, said sliding door locking means having a first operative position solely securing said sliding door in a locked relationship with said housing completely covering said portal opening and having a second operative position solely allowing the translation of said door from said portal opening revealing said interior chamber, a shackle supported by said housing having a first segment extending beyond said housing and a second segment within said housing, said shackle for supporting the housing on a door, shackle locking means for locking said shackle to a door,

21. An article or key safe comprising, in combination:

a housing having a front wall wtih a portal opening to an interior chamber of said housing where the key is retained, said portal opening having two sides provided with opposed trackways, a sliding door dimensioned to occlude said portal by sliding within said trackways, sliding door locking means for locking said sliding door to the housing to occlude said portal, a shackle supported by said housing having a first segment extending beyond said housing and a second segment within said housing, said shackle for supporting the housing on a door, shackle locking means for locking said shackle to a door, a barrier precluding access to said shackle from said interior chamber of said housing.

22. An article or key safe comprising, in combination:

a housing having a front wall with a portal opening to an interior chamber of said housing where the key is retained, said portal opening having two sides provided with opposed trackways, a sliding door dimensioned to occlude said portal by sliding within said trackways, sliding door locking means for locking said sliding door to the housing to occlude said portal, a shackle supported by said housing having a first segment extending beyond said housing and a second segment within said housing, said shackle for supporting the housing on a door, shackle locking means for locking said shackle to a door, a barrier precluding access to said sliding door locking means from said interior chamber of said housing.

* * * * *